US005996188A

United States Patent [19]

Yaguramaki et al.

[11] Patent Number: 5,996,188

[45] Date of Patent: Dec. 7, 1999

[54] SLIDE FASTENER SLIDER WITH AUTOMATIC LOCK MECHANISM

[75] Inventors: Iwao Yaguramaki; Masao Kubo; Noboru Oyama, all of Toyama-ken, Japan; Jiro Harada, Jakarta, Indonesia

[73] Assignee: YKK Corporation, Tokyo, Japan

[21] Appl. No.: 09/259,374

[22] Filed: Feb. 26, 1999

[30] Foreign Application Priority Data

Mar. 16, 1998 [JP] Japan ..... 10-065451

[51] Int. Cl.[6] ..... A44B 19/00

[52] U.S. Cl. ..... 24/424; 24/418; 24/419; 24/421

[58] Field of Search ..... 24/424, 418, 419, 24/421, 422, 423, 429; 70/68

[56] References Cited

U.S. PATENT DOCUMENTS

| | | | |
|---|---|---|---|
| 3,919,745 | 11/1975 | Dupon | 24/424 |
| 4,667,376 | 5/1987 | Ishii et al. | 24/424 |
| 5,625,928 | 5/1997 | Terada et al. | 24/421 |
| 5,694,667 | 12/1997 | Mizuno | 24/421 |

*Primary Examiner*—Victor N. Sakran
*Attorney, Agent, or Firm*—Hill & Simpson

[57] ABSTRACT

A slide fastener slider with an automatic lock mechanism comprises a body including a support lug standing on a guide post, a guide lug standing at a rear opening side of the body, a recessed portion defined between the support lug and the guide lug, a pair of projections project from opposite sides of the recessed portion. A spring is mounted to the body with its V-shaped bent portion of the spring fitted into the recessed portion. The bent portion is then fixed by caulking the projections. A pintle of a pull tab is disposed on the spring. A pawl member, which has an pressing portion to be brought into resilient contact with the spring on its one end, the locking paws on the other end, and a support shaft at opposite sides of an intermediate portion thereof, is disposed on the pintle. The support shaft is axially supported on the support lug, the locking pawl side at a rear end of the pawl member is guided by the guide pawl, and the locking pawl is allowed to pivotally move for being fitted into and detached from the fastener elements by operating the pull tab. In the slider with the automatic lock mechanism, therefore, the pawl member and the spring can be easily disposed and assembled, and the pivotal movement of the pawl member can be guided on the locking pawl side.

10 Claims, 10 Drawing Sheets

SLIDE FASTENER SLIDER WITH AUTOMATIC LOCK MECHANISM

BACKGROUND OF THE INVENTION

1. Field of the Invention

The present invention relates to a slide fastener slider having an automatic lock mechanism, wherein the slider comprises a body, a pawl member, a spring and a pull tab. The pawl member has a locking pawl at an end thereof. The spring has an intermediate portion to be fixed in a recessed portion inscribed on an upper face of the body, and has one end thereof to be brought into resilient contact with a front end portion of the pawl member. A rear end portion of the pawl member is formed so as to be pivotally movable along a guide lug standing on the body.

2. Description of the Related Art

A conventional slider having an automatic lock mechanism of this type, which comprises a body, a pawl member, a spring, and a pull tab, is disclosed in, for example, U.S. Pat. No. 3,919,745. In the known slider, as shown in FIG. 15, a recessed groove 21' for accommodating a plate spring 3' is inscribed in a guide post 7' of a body 1' of the slider, so that the plate spring 3' can be accommodated in the recessed groove 21' and is fixed by caulking a fixing member 40' thereof mounted in an inner portion of the recessed groove 21'. A tip end of the plate spring 3' is brought into resilient contact with an end of a pawl member 2'. The pawl member 2' has at one end portion thereof a locking pawl 26' to be retractably fitted and inserted into a pawl hole 14'. The pawl member 2' further has a support shaft 27' projecting at opposite sides on the other end side portion thereof, which is axially supported on a support lug 10' standing on the body 1'. A pintle 35' of a pull tab 4' is disposed between a projection 11' and the support lug 10' standing on the body 1' so as to make the pawl member 2' move pivotally.

In the above-described slide fastener slider with the automatic lock mechanism shown in FIG. 15, it is the plate spring 3' that activates the pawl member 2' having the locking pawl 26' in the automatic lock mechanism. Because the plate spring 3' is mounted to the body 1' by only caulking the fixing member 40' projecting on an upper face of the body 1', a fixed portion of the spring 3' may be loosened and the spring 3' may fall off if the slider is used for a long time. Or, the spring 3' may not be activated appropriately because of its displacement.

Furthermore, such a slider is not suitable particularly for a slider having the automatic lock mechanism and equipped with a wire spring made of spring steel, because a mounting operation of the spring 3' and an assembling operation of the slider are difficult. Moreover, because a portion for guiding the pivotal movement of the pawl member 2' is the projection 11' disposed inside the locking pawl 26', activation of the locking pawl 26' may go wrong.

SUMMARY OF THE INVENTION

The present invention has been accomplished in view of the above problems. Therefore, It is a main object of the present invention to provide a slider with an automatic lock mechanism comprising a body, a pawl member, a spring, and a pull tab, wherein the spring for activating the pawl member having a locking pawl can be easily disposed, the slider can be easily assembled, and the spring mounted to the body dose not fall off or is not displaced even when used for a long time, thus the slider has durability.

Further, it is another main object of the present invention to provide a slider with an automatic lock mechanism, wherein a structure of the automatic lock mechanism is simple and has a strong resilience, the slider is particularly suitable for a slider employing a wire spring made of spring steel, pivotal movement of the pawl member is guided on a side of the locking pawl so as to prevent displacement of activation of the locking pawl, and the slider has a superior performance with an excellent locking function.

It is a further object of the present invention to provide a slide fastener slider with an automatic lock mechanism, wherein the spring can be firmly and easily fixed to the body, and a resilient force of the spring mounted to the body can act efficiently and appropriately, by specifying a fixing and mounting form of the spring.

It is a further object of the present invention to provide a slide fastener slider with an automatic lock mechanism, wherein excessive lifting of the locking paw of the pawl member by operation of the pull tab can be prevented, and pivotal movement or rotation of the pawl member is positively regulated by a simple structure, thereby allowing a smooth sliding operation of the slider.

It is a still further object of the present invention to provide a slide fastener slider with an automatic lock mechanism, wherein the spring can be appropriately and easily mounted to the body without displacement of a fixing position of the spring, by specifying a shape of the spring which activates the pawl member.

It is a still further object of the present invention to provide a slide fastener slider with an automatic lock mechanism, wherein the spring mounted to the body is prevented from freely rotating or deviating in a widthwise direction of the spring, thus can be operated accurately, and can exhibit an excellent resilient force.

Further, it is an object of the present invention to provide a slide fastener slider with an automatic lock mechanism, wherein the automatic lock mechanism which prevents falling off and displacement of the spring can be easily applied to the sliders comprising various types of the pawl members and the bodies, such that a range of applications of the slider can be increased, by specifying shapes of the pawl member and the body of the slider.

In order to achieve the foregoing objects, according to this invention, there is provided a slide fastener slider with an automatic lock mechanism, which comprises four members, i.e. a body, a pawl member, a spring and a pull tab including the following structures. The body includes a support lug projecting on a guide post, a guide lug projecting at a rear opening side of an upper wing plate, a pawl hole defined inside or outside the guide lug, a recessed portion defined between the support lug and the guide lug, and a pair of projections projecting in a vicinity of the recessed portion. The pawl member has a locking pawl formed to project from one end portion of the pawl member, a pressing portion at the other end portion and a recess defined at an intermediate portion thereof. The spring is bent into a V-shape to form a bent portion. The pull tab has a pintle. The bent portion of the spring is fitted into the recessed portion and fixed by caulking the projections, and an end of the spring is brought into resilient contact with the pressing portion of the pawl member, while the other end of the spring is disposed in the guide lug. The pawl member is axially supported on the support lug in such a manner that the locking pawl is retractably fitted and inserted into the pawl hole. The pintle of the pull tab is fitted into the recess of the pawl member, so that the end portion of the pawl member can pivotally move along the guide lug.

Preferably, the projections project from opposite sides of the recessed portion inscribed on the upper wing plate, and the bent portion of the spring fitted into the recessed portion is fixed by caulking the projections from opposite sides.

Alternatively, the projections may project at a portion toward the support lug deviating from opposite sides of the recessed portion inscribed on the upper wing plate, the bent portion of the spring is fitted into the recessed portion, and the spring is fixed by caulking the projections from opposite sides.

Further, it is preferable that the pressing portion of the pawl member is in resilient contact with the end of the spring, or the pressing portion can abut on the upper wing plate via the spring, so as to regulate the pivotal movement of the pawl member.

Furthermore, the pawl member may have a hook defined at a tip end of a base portion of the locking pawl thereof, the guide lug has a hooked portion defined at a bridge portion thereof, so that the hook and the hooked portion can be engaged with each other so as to regulate the pivotal movement of the pawl member.

Further preferably, the bent portion of the spring may have an angular projecting portion projecting outward, the projecting portion is fitted into the recessed portion, and the projections are caulked to fix the spring.

Still further, the guide lug projecting from the rear opening portion of the upper wing plate may include opposite walls and the bridge portion, and an accommodating groove with substantially the same width as a diameter of the spring is defined in an inner face of the bridge portion so as to prevent rotation of the spring.

It is further preferable that the pawl member has a solid body substantially in a V-shape, and further includes a support shaft projecting from opposite sides of a center of the pawl member and a recessed streak groove defined at a lower face between the recess and the pressing portion, the locking pawl projecting from a deviating position at a lower face of the one end portion of the pawl member, the recess being defined between the support shaft and the locking pawl, and a pair of the support lugs are formed to stand and face each other on the guide post, the accommodating groove being defined at a deviating position of the bridge portion of the guide lug standing at the rear opening portion. The spring is accommodated in the recessed portion and fixed by the projections, and the support shaft of the pawl member is axially supported on the support lugs such that the locking pawl is retractably fitted and inserted into the pawl hole. The end of the spring is brought into resilient contact with the pressing portion along the recessed streak groove while th e other end of the spring is retractably fitted and inserted into the accommodating groove of the guide lug.

Alternatively, the pawl member may have a solid body substantially in an angular U shape, and further includes a support shaft projecting from opposite sides of a center of the pawl member, the locking pawl projecting from a deviating position at a lower face of the one end portion of the pawl member, the hook portion projecting from a deviating position at a tip end of the other end portion of the pawl member, the recess being defined between the support shaft and the locking pawl. The pressing portion is retractably fitted and inserted into a concave portion on the guide post, and the spring is accommodated into a recessed groove diagonally defined and extending from the concave portion to the recessed portion. Said other end of the spring is fitted and inserted into the accommodating groove defined at a deviating position of the bridge portion of the guide lug. The support shaft is axially supported on a pair of the support lugs standing on opposite sides of the recessed groove to face each other. The hook are engaged with the hooked portion at a deviating position of the bridge portion.

Still alternatively, the pawl member may have a cover body in a shape of a bottom of a ship and includes a pair of locking pawls projecting from side walls at a rear portion of the pawl member, the hook formed by inwardly bending a lower portion of an end of the pawl member, and the pressing portion formed by inwardly bending a lower portion of the other end of the pawl member, the support lug and the guide lug have a gap portion and an accommodating groove each having substantially the same width as a diameter of the spring respectively defined at inner faces of the support lug and the guide lug, and the pawl hole is defined outside the guide lug. The spring is accommodated into the recessed portion on the upper wing plate and is fixed by the projections, the pawl member is pivotally supported on the support lug so as to cover the support lug and the guide lug. The end of the spring is inserted through the gap portion of the support lug and is brought into resilient contact with the pressing portion, while the other end of the spring is fitted and inserted into the accommodating groove of the guide lug. The hooked portion projecting from the guide lug and the hook are engaged with each other.

DESCRIPTION OF THE PREFERRED EMBODIMENTS

Figure 1:
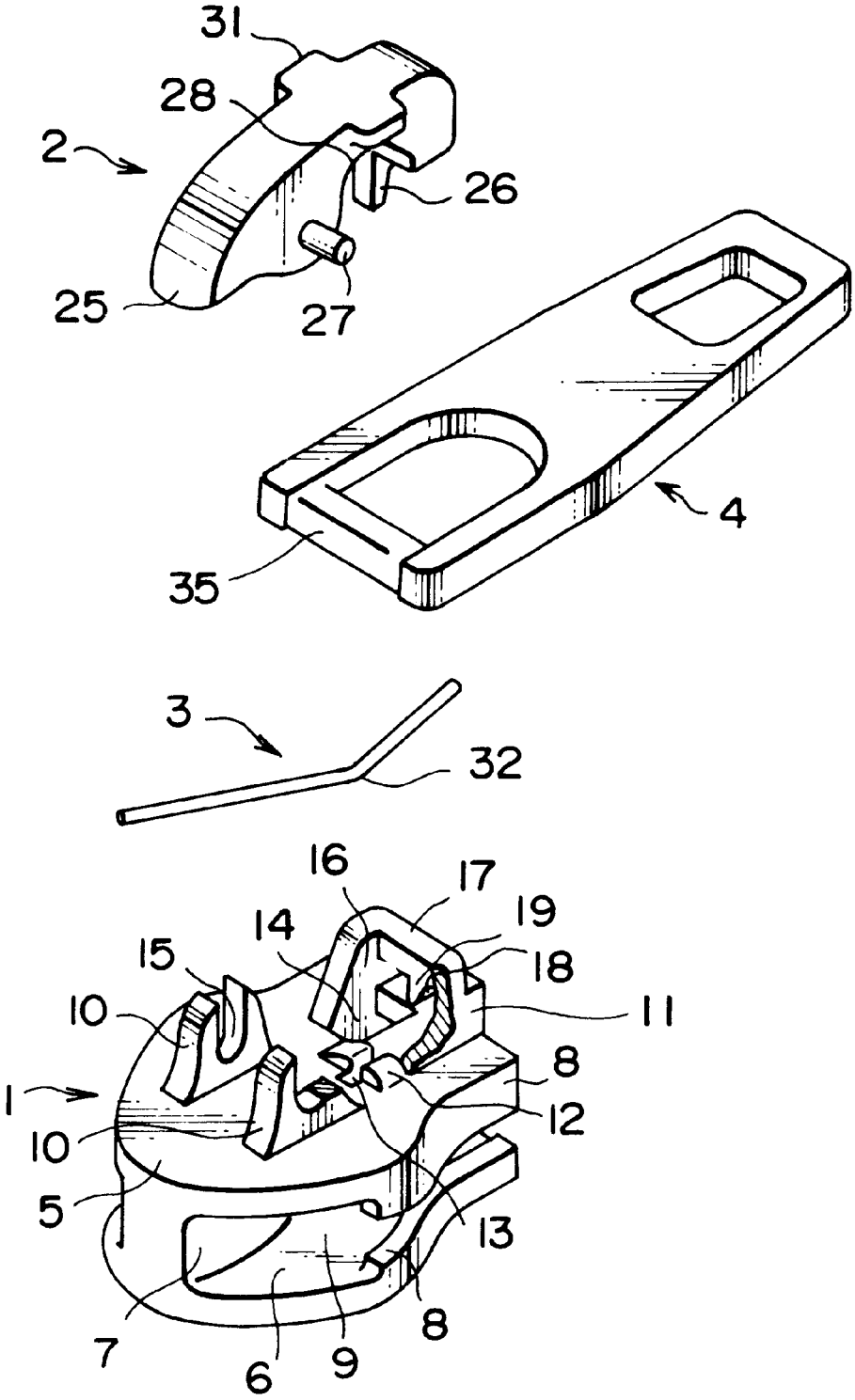
FIG. 1 is in exploded perspective view of a slider with an automatic lock mechanism according to a first embodiment of this invention.
Figure 2:
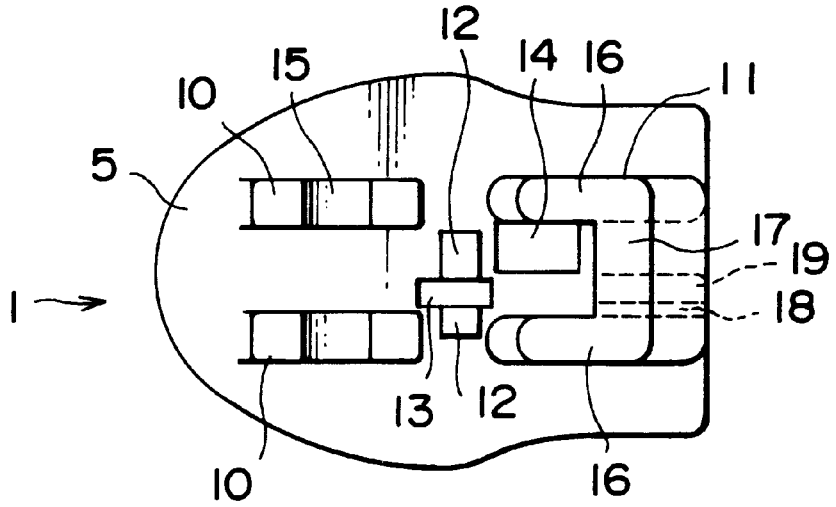
FIG. 2 is a plan view of a body of the same slider.
Figure 3:
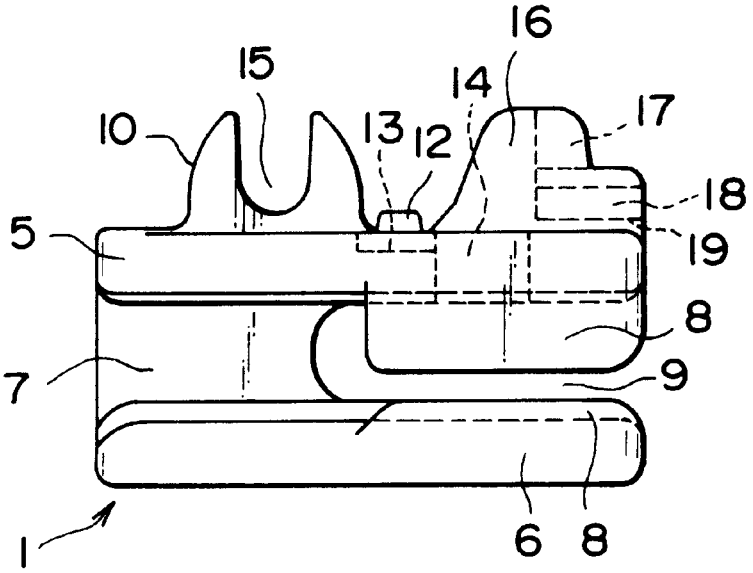
FIG. 3 is a side view of the body of the same slider.

Embodiments of a slide fastener slider with an automatic lock mechanism according to the present invention will be described in detail below by reference to the drawings.

The slide fastener slider with an automatic lock mechanism comprises four members, i.e., a body 1, a pawl member 2, a spring 3, and a pull tab 4. The body 1 and the solid pawl member 2 are die-cast molded by using aluminum alloy, zinc alloy, or the like. When the pawl member 2 has a cover body, it is molded by press using metal plate. The pull tab 4 is die-cast molded by using metal or molded by metal plate pressing. For the spring 3, a wire spring or a plate spring made of spring steel is used.

In a slider with an automatic lock mechanism according to a first embodiment of this invention as shown in FIGS. 1 to 5, an upper wing plate 5 and a lower wing plate 6 of the body 1 are connected by a guide post 7 at a front opening side thereof. Side edges of the upper wing plate 5 and the lower wing plate 6 are provided with guide flanges 8 in a bent state for guiding fastener elements. Between the side edges of the upper wing plate 5 and the lower wing plate 6, guide grooves 9 into which the fastener elements can be inserted are formed. The body 1 has a pair of plate-shaped support lugs 10 formed to stand on the front opening side of the body 1, i.e. on the guide post 7. The support lugs 10 are disposed with such a distance therebetween that the pawl member 2 can be fitted therein. Each the support lug 10 has at its upper portion a U-shaped bearing portion 12 for axially supporting a support shaft 27 of the pawl member 2.

Figure 6:
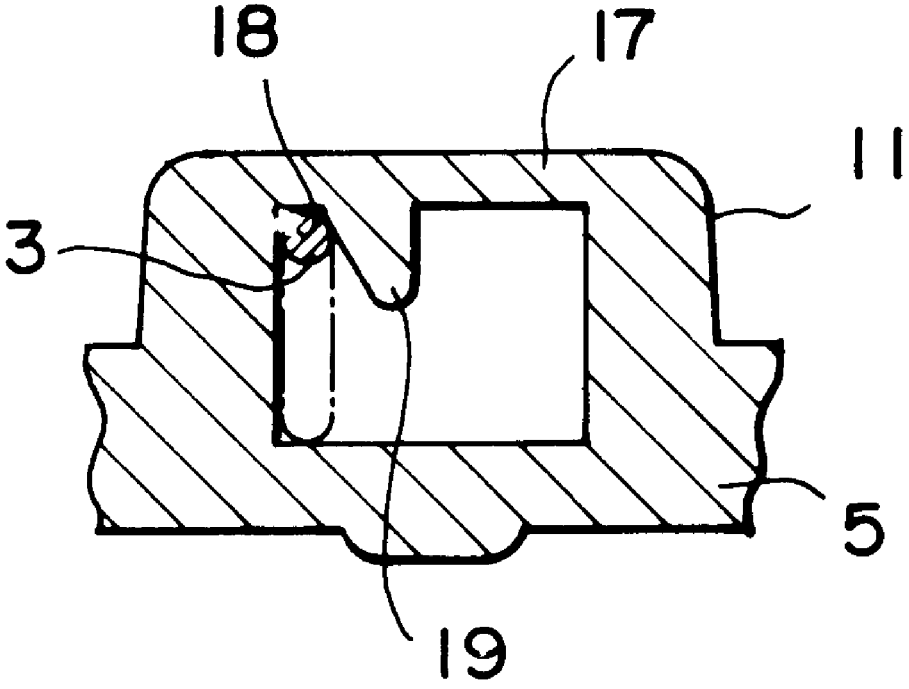
FIG. 6 is a cross sectional view of a spring-fixing mechanism of the same slider.
Figure 7:
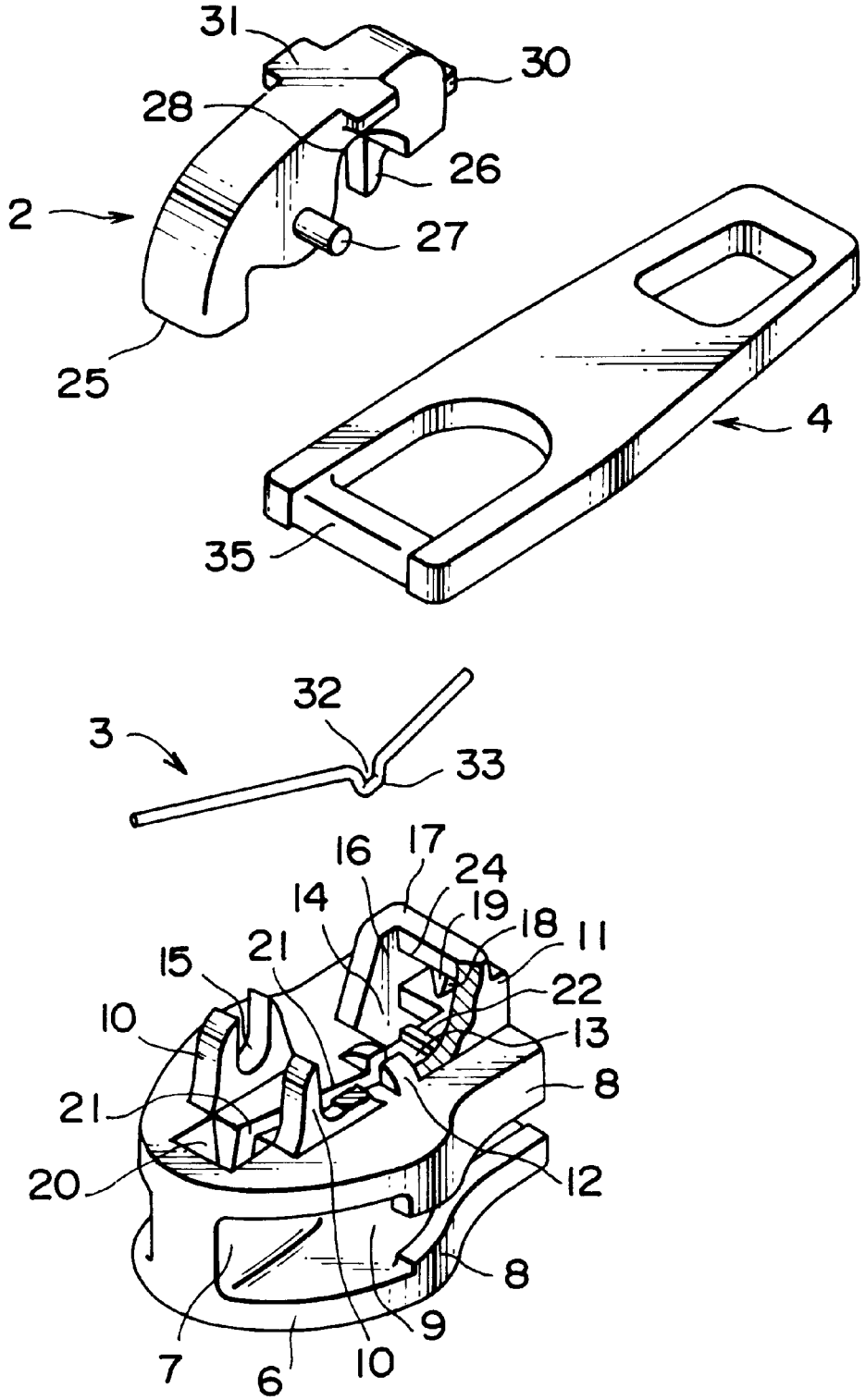
FIG. 7 is an exploded perspective view of a slider with an automatic lock mechanism according to a second embodiment of this invention.

The body 1 further has a guide lug 11 formed to stand on a rear opening side thereof and comprising opposed side walls 16 and a bridge portion 17 for connecting upper portions of the side walls 16. At a position toward one side wall 16 inside the guide lug 11, a pawl hole 14 is defined such that a locking pawl 26 of the pawl member 2 is retractably fitted and inserted through into the pawl hole 14 and down to the element guide groove 9 of the body 1. The guide lug 11 has an accommodating groove 18 formed at a lower face of the bridge portion 17 and at a position toward an opposite side to the pawl hole 14 for accommodating an end portion of the spring 3 and having substantially the same width as a diameter of the spring 3 as shown in FIG. 6. The accommodating groove 18 is formed by forming a protuberance 19 projecting from the lower face of the bridge portion 17.

A long and narrow recessed portion 13 for accommodating a bent portion 32 of the spring 3 is defined at an intermediate portion between the support lugs 10 and the guide lug 11 of the body 1 on a side which does not face the pawl hole 14, i.e., on a side which faces the accommodating groove 18. A pair of projections 12 are formed to project from opposite sides of the recessed portion 13 and to face each other such that the spring 3 can be fixed by caulking the projections 12.

The pawl member 2 has a substantially inverted V-shaped solid body which can be mounted inside the support lugs 10 and the guide lug 11 respectively disposed on the body 1. The pawl member 2 has at its end a pressing portion 25 for abutting on and pressing the spring 3, and at its the other end the locking pawl 26 which can be inserted between the fastener elements and which project at a deviating position so as to face the pawl hole 14 of the body 1. A curved recess 28 is defined at an inside base portion of the locking pawl 26 such that a pintle 35 of the pull tab 4 is held in the recess 28. A support shaft 27 to be fitted into the bearing portions 15 projects from side faces of the pawl member 2 at an intermediate position thereof between the recess 28 and the urging portion 25.

Figure 4:
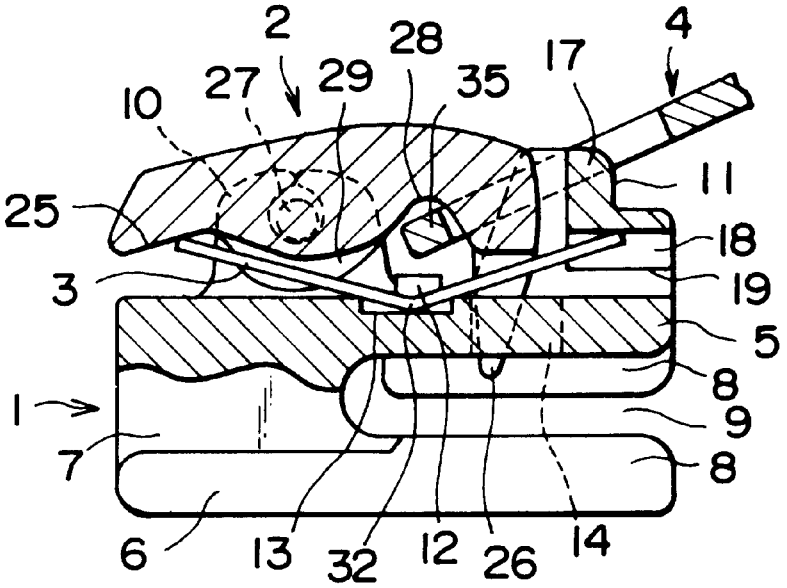
FIG. 4 is a vertical sectional view of the same slider when the slider is locked.
Figure 5:
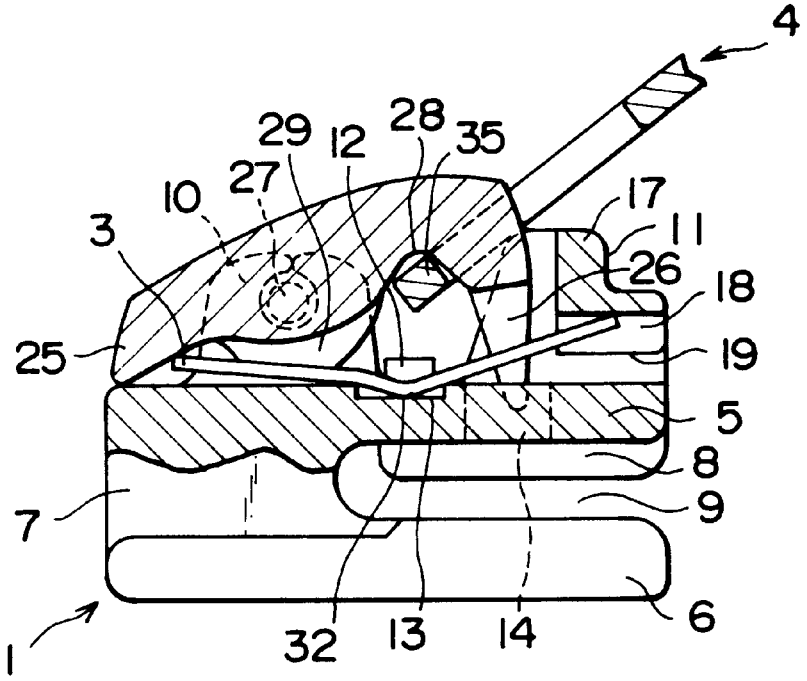
FIG. 5 is a vertical sectional view of the same slider when the slider is slidable.

The pawl member 2 has a pair of tongue portions 31 each having substantially the same width as the support lugs 10 and the guide lug 11, projecting from opposite sides of a top face above the recess 28 thereof such that the tongue portions 31 are interposed between the support lugs 10 and the guide lug 11, thereby maintaining the pawl member 2 in a stable state, and preventing the pull tab 4 from falling sideways, and enabling the pull tab 4 to pivot smoothly. A recessed streak groove 29 for accommodating the spring 3 is inscribed on a lower face of the pawl member 2 below the support shaft 27. The recessed streak groove 29 gives a space for allowing the spring 3 to be resiliently deformed relative to the pawl member 2, as shown in FIG. 4.

The spring 3 is a wire spring made of spring steel bent in a V-shape at a substantially center portion thereof to form a bent portion 32. The bent portion 32 can be fitted into the recessed portion 13 defined on the body 1. The spring 3 is not necessarily a wire spring, but may be a plate spring. The pull tab 4 is in a rectangular shape and has at its end a pintle 35 to be fitted into the recess 28 of the pawl member 2.

The slider having the automatic lock device is assembled by mounting the spring 3 to the body 1 by fitting the bent portion 32 of the spring 3 which is bent into a V shape into the recessed portion 13 inscribed on the upper wing plate 5 of the body 1, and simultaneously caulking the projections 12 formed on opposite sides of the recessed portion 13 in such a manner that an end of the spring 3 is accommodated in the accommodating groove 18 defined in the guide lug 11. In this state, the pintle 35 of the pull tab 4 is disposed between the support lugs 10 and the guide lug 11. The pawl member 2 is placed over and fitted between the support lugs 10 and in the guide lug 11. At the same time, the locking pawl 26 is retractably fitted and inserted into the pawl hole 14, and the support shaft 27 is fitted into the bearing portions 15 of the support lugs 10. After an end portion of the spring 3 abuts on the pressing portion 25 of the pawl member 2, the support lugs 10 are caulked to fix the pawl member 2 to the body 1, thereby assembling the slider.

When the spring 3 is mounted, it is also possible to dispose a spring 3 in a shape of a straight line on the upper wing plate 5 and then to mold the spring 3 into the V shape by punching in the recessed portion 13. The slider is assembled by an automatic assembling machine.

A operation of the assembled slider with the automatic lock device is as follows. If the pull tab 4 is pulled forward or rearward, the pawl member 2 moves pivotally about the support shaft 27 as a center until the pressing portion 25 abuts on the upper wing plate 5. As an end of the pawl member 2 is guided by the guide lug 11, the locking pawl 26 is pulled up from between the fastener elements, so that the slider can be allowed to freely slide. If the pull tab 4 is released, the pressing portion 25 is pushed up by a resilient force of the spring 3, and the locking pawl 26 projects automatically to be inserted between the fastener elements, thereby locking the slider.

Figure 10:
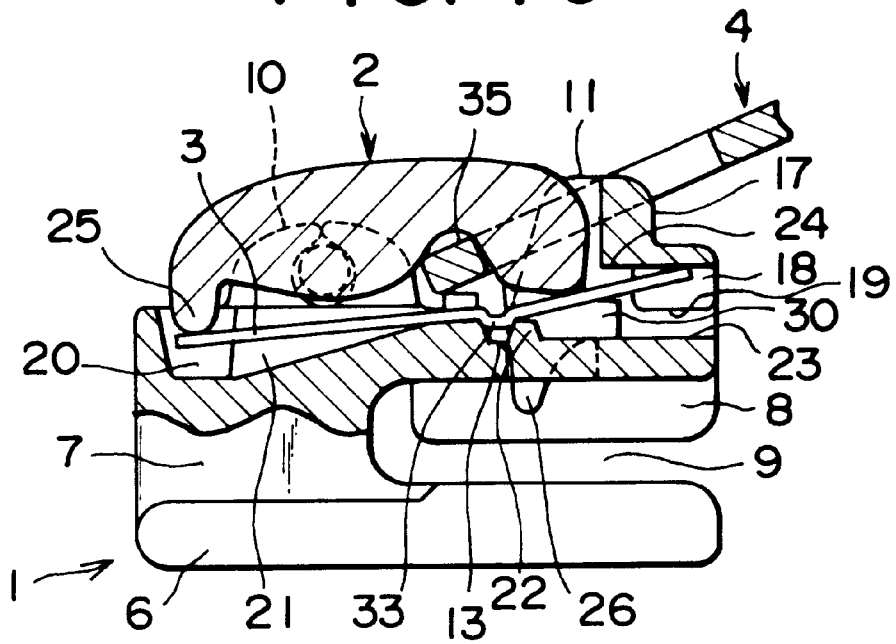
FIG. 10 is a vertical sectional view of the same slider when the slider is locked.
Figure 11:
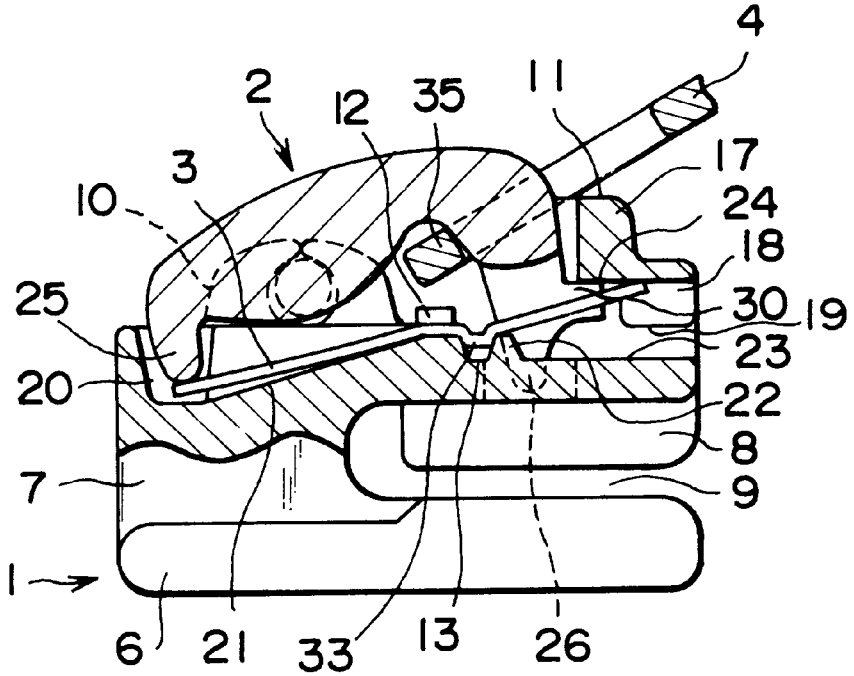
FIG. 11 is a vertical sectional view of the same slider when the slider is slidable.

In a slider with an automatic lock mechanism according to a second embodiment of this invention as shown in FIGS. 7 to 11, an angular concave portion 20 is defined on an upper wing plate 5 of the body 1, i.e., at a center of an upper face of the guide post 7, and a recessed groove 21 in an angular U shape or a U-shape is inscribed extending from the concave portion 20 to a side portion of the pawl hole 14 defined inside the guide lug 11 at a rear opening side. As shown in FIGS. 10 and 11, a depth of the recessed groove 21 gradually decreases from the concave portion 20 to a center of the body 1. A pair of projections 12 are formed to project at opposite sides of a shallowest portion of the recessed groove 21. A recessed portion 13 is defined at an end portion of the recessed groove 21 adjacent to the projections 12. Further, a projecting streak portion 22 is defined at a tip end of the recessed portion 13. Furthermore, a recessed face 23 which is lower than the projecting streak portion 22 is formed inside the guide lug 11 extending from the projecting streak portion 22 to the rear opening of the slider.

Figure 8:
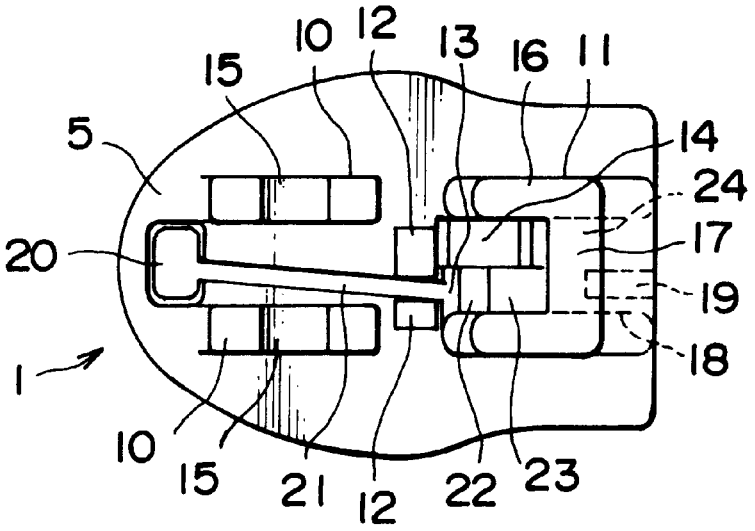
FIG. 8 is a plan view of a body of the same slider.
Figure 9:
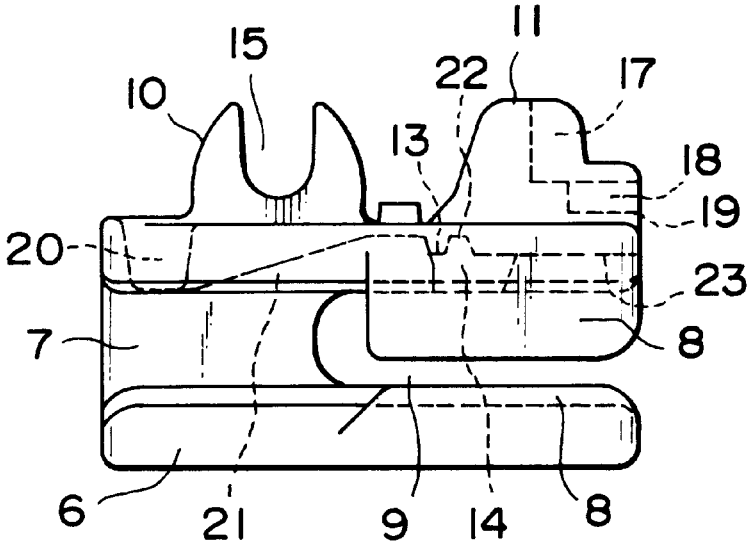
FIG. 9 is a side view of the body of the same slider.

As shown in FIG. 8, the recessed groove 21 is inscribed slightly diagonally in a plan view. In other words, the recessed groove 21 is formed diagonally from a center of the concave portion 20 toward a side portion of the pawl hole 14. Alternatively, the recessed groove 21 may be inscribed in a crank shape to extend longitudinally from the center of the concave portion 20 toward the rear opening of the body 1, and then the recessed groove 21 may be bent at its intermediate portion in a hook shape while forming a right angle so as to avoid the pawl hole 14. If the recessed groove 21 is formed in such a crank shape, a pair of projections 12 are formed to project at the intermediate bent portion on a longitudinal line of the body 1, and the recessed portion 13 is formed between the projections 12.

The upper wing plate 5 has a pair of support lugs 10 standing on opposite sides of the recessed groove 21 on an upper face of the guide post 7. Each the support lugs 10 has at an upper portion thereof a U-shaped bearing portion 15. Further, a guide lug 11 stands to extend from the rear opening side of the upper wing plate 5, i.e., from the recessed portion 13 to the rear opening of the body 1. The guide lug 11 comprises a pair of side walls 16 and a bridge portion 17 for connecting upper portions of the side walls 16. A pawl hole 14 is defined at a position toward one inner side of the guide lug ll. The guide lug 11 further has a hooked portion 24 formed at the bridge portion 17 above the pawl hole 14. Further, an accommodating groove 18 for preventing rotation or falling of the spring 3 is defined in the bridge portion 17 above extension of the recessed groove 21. The accommodating groove 18 is formed by forming a protuberance 19 projecting from a lower face of the bridge portion 17 and having substantially the same distance as a diameter of the spring 3 such that an end of the spring 3 can be accommodated in resilient contact with the accommodating groove 18.

The pawl member 2 has a solid body having an entire width which is substantially the same as a distance between the support lugs 10 or an inside width of the guide lug 11, and side faces of the pawl member 2 are substantially in an angular U shape. The pawl member 2 has at an end thereof an pressing portion 25 for pressing the spring 3 and fitting and inserting the spring 3 into the concave portion 20. Further, a locking pawl 26 to be retractably fitted and inserted into the pawl hole 14 is formed to project from a deviating position of a lower face of the other end of the pawl member 2. A hook 30 is formed at a deviating position to project in a tongue shape in a longitudinal direction on a side of a tip end of the spring 3.

A support shaft 27 to be fitted and inserted into the bearing portions 15 of the support lugs 10 is laterally formed on side faces of the pawl member 2 toward the pressing portion 25. A recess 28 is formed between the support shaft 27 and the locking pawl 26 for receiving a pintle 35 of the pull tab 4. Further, a pair of tongue portions 31 are formed to project sideways of the pawl member 2 and have the same width as the support lugs 10 and the guide lug 11. The tongue portions 31 are interposed between the support lugs 10 and the guide lug 11 and are intended to stabilize the pawl member 2 and to facilitate operation of the pull tab 4.

The spring 3 is a wire spring bent in a V-shape at a center portion thereof to form a bent portion 32. The bent portion 32 has a projecting portion 33 to be fitted into the recessed portion 13 defined in the upper wing plate 5. If the spring 3 is a spring 3 made of a plate spring having a small width but the same shape as the above spring, the spring 3 can be used easily. The pull tab 4 is in a rectangular shape and has at an end thereof with a pintle 35 to be fitted into the recess 28 of the pawl member 2.

The slider having the automatic lock device is assembled by fitting the spring 3 into the recessed groove 21 inscribed on the upper wing plate 5 of the body 1. At this time, the projecting portion 33 of the spring 3 is fitted into the recessed portion 13 of the recessed groove 21 and an end of the spring 3 is fitted into the accommodating groove 18 defined inside the guide lug 11 of the body 1 as shown in FIG. 10. Then, the projections 12 projecting on the body 1 are caulked on the spring 3 to fix the spring 3. The support shaft 27 of the pawl member 2 is fitted into the bearing portions 15 of the support lugs 10 in a state wherein the pintle 35 of the pull tab 4 abuts on the recess 28, and the hook 30 at the end of the pawl member 2 is fitted into the hooked portion 24 defined at the bridge portion 17 of the guide lug 11. The locking pawl 26 is retractably fitted and inserted into the pawl hole 14 and an end of the spring 3 is pressed by the pressing portion 25 to be fitted and inserted into the concave portion 20. Then, tip ends of the bearing portions 15 are caulked to support the support shaft 27 so as to be pivotally movable, thereby assembling the slider with the automatic locking mechanism. When the spring 3 is mounted, it is also possible to dispose a spring 3 in a shape of a straight line in and along the recessed groove 21 and then to mold the spring 3 into the V shape by punching in the recessed portion 13.

A sliding operation of the assembled slider with the automatic locking mechanism is as follows. Similarly to the first embodiment, by pulling the pull tab 4 forward or rearward, the pawl member 2 moves pivotally about the support shaft 27 as a center until the hook 30 of the pawl member 2 abuts on the hooked portion 24. Simultaneously, by pressing one end of the spring 3 toward the concave portion 20 with the pressing portion 25, the locking pawl 26 can be lifted to allow the slider to slide freely. By releasing the pull tab 4, the pressing portion 25 is pushed up by a resilient force of the spring 3, and the locking pawl 26 automatically projects to be inserted between the fastener elements, thereby locking slider.

Figure 12:
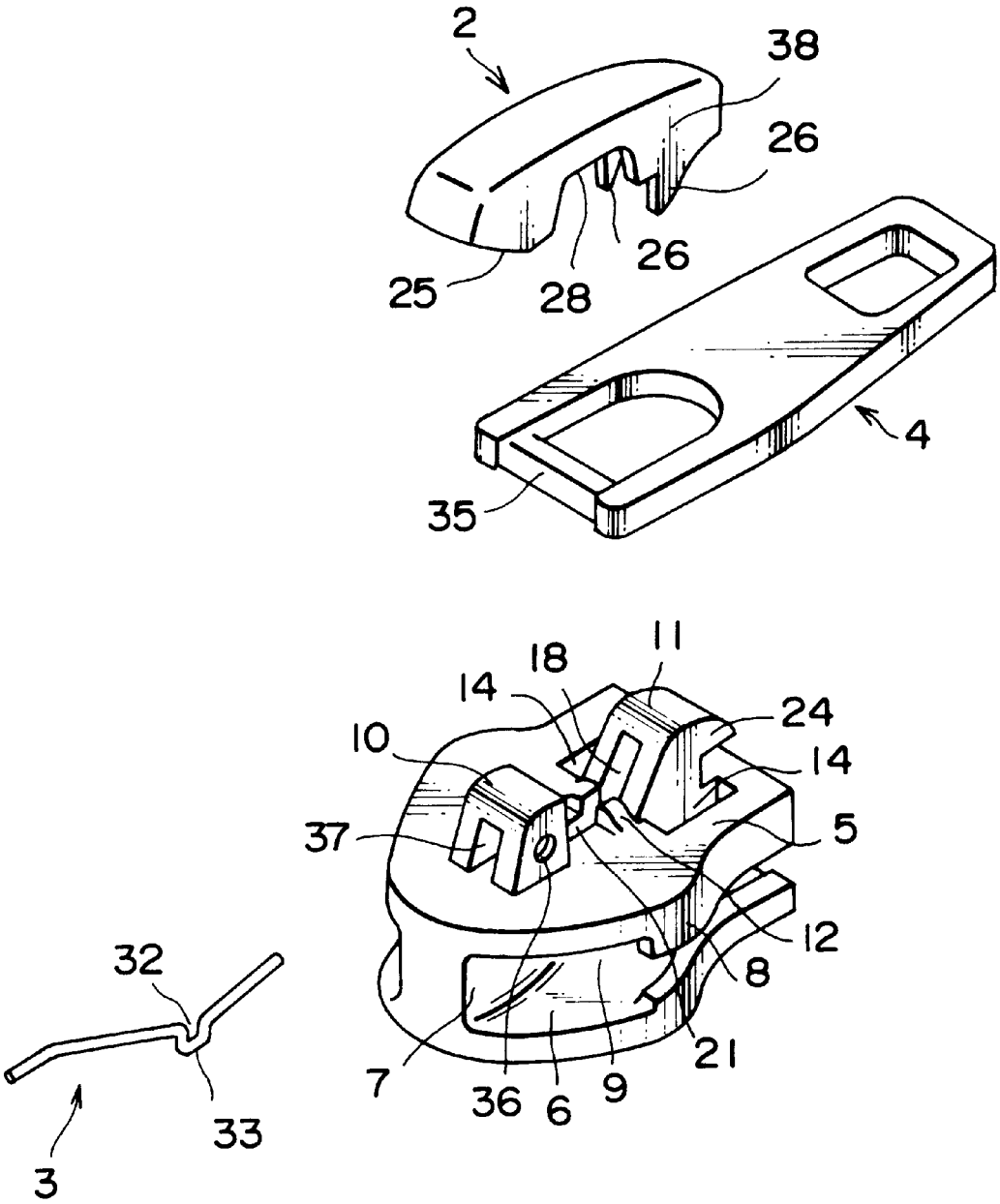
FIG. 12 is an exploded perspective view of a slider with an automatic lock mechanism according to a third embodiment of this invention.
Figure 13:
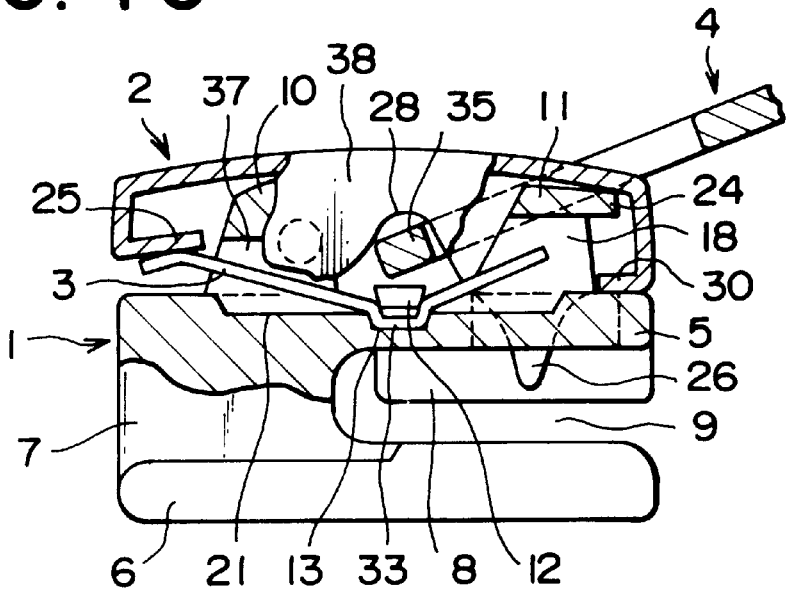
FIG. 13 is a vertical sectional view of the same slider when the slider is locked.
Figure 14:
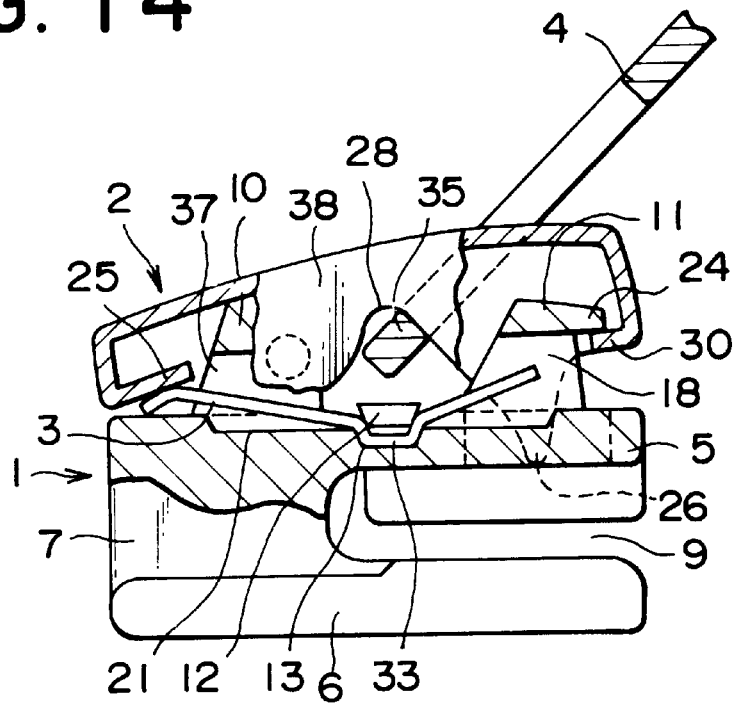
FIG. 14 is a vertical sectional view of the slider when the slider is slidable.
Figure 15:
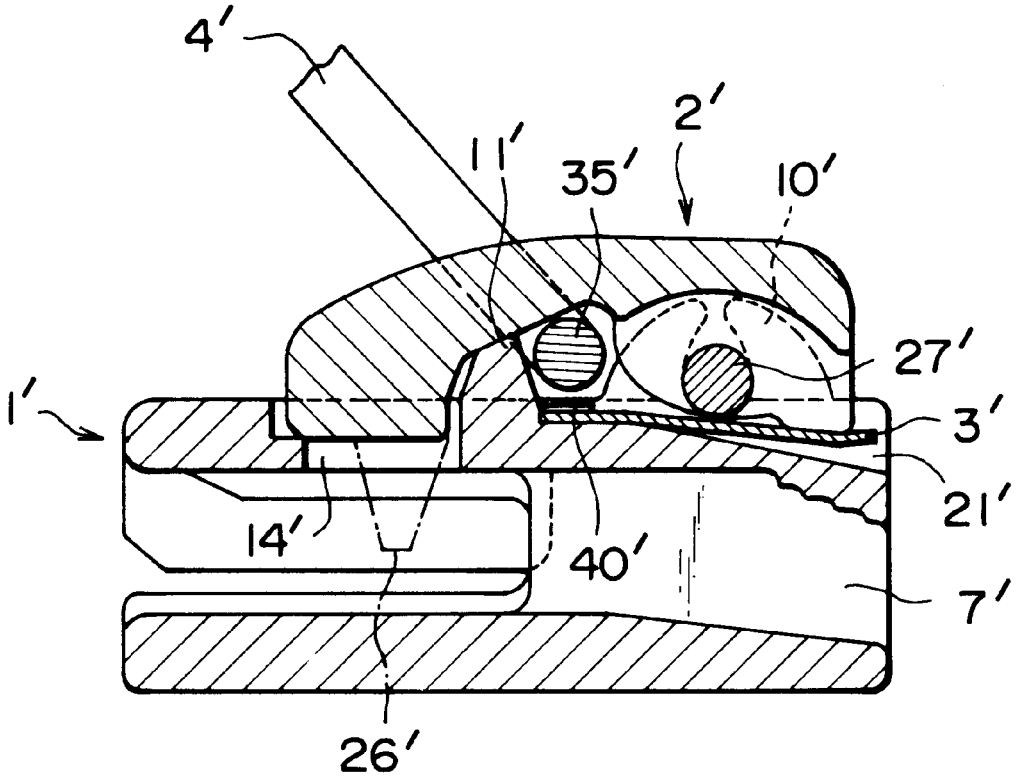
FIG. 15 PRIOR ART
FIG. 15 is a vertical sectional view of a known slider with an automatic lock mechanism when the slider is locked.

Next, in a slide fastener slider with an automatic lock mechanism according to a third embodiment of this invention shown in FIGS. 12 to 14, a support lug 10 with a front face an inverted angular U shape is formed to stand on an upper e of an upper wing plate 5 of a body 1, i.e., on an upper e of the guide post 7. The support lug 10 has at a center thereof a longitudinal gap portion 37 into which the spring n be inserted and has a shaft hole 36 penetrating laterally the support lug 10. A guide lug 11 having an inverted angular U shape in cross section is formed to stand on a rear opening side of the upper wing plate 5. Further, a pair of pawl holes 14 into which locking pawls 26 can be retractably fitted and inserted are defined on opposite positions outside the guide lug 11 on the upper wing plate 5. A hook portion 24 is formed to project from a rear end of a top face of the guide lug 11. Furthermore, a recessed groove 21 into which a spring 3 is fitted and inserted as shown in FIGS. 13 and 14 is inscribed along a center line extending from the support lug 10 to the guide lug 11 on the upper face of the upper wind plate 5. A recessed portion 13 is defined in the recessed groove 21 at an intermediate position between the support lug 10 and the guide lug 11. A pair of projections 12 for fixing the spring 3 are formed to project from opposite banks of the recessed portion 13.

A pawl member 2 is formed into a cover body in a shape of a bottom of a ship by pressing using a metal plate. The pawl member 2 has at centers of opposite sides thereof a recess 28 into which a pintle 35 of the pull tab 4 can be inserted. A lower portion of an end portion of the pawl member 2 on a side for covering the support lug 10 is bent inwardly, as shown in FIGS. 13 and 14, to form an pressing portion 25 which is brought into resilient contact with the spring 3. A lower portion of the other end portion of the pawl member 2 on opposite side to the pressing portion 25, i.e. on a side for covering the guide lug 11, is also bent inwardly to form a hook 30 for engaging with he hooked portion 24 of the guide lug 11. A pair of locking pawls 26 to be retractably fitted and inserted into the pawl holes 14 are formed to project from opposite side walls 38 of the pawl member 2 at the inner side of the hook portion 30 in a staggered manner.

The spring 3 is a wire spring and is bent at a center thereof into a V shape to form a bent portion 32, similarly to the second embodiment. The bent portion 32 has a projecting portion 33 which projects and which can be fitted into the recessed portion 13. If the spring 3 is a spring 3 made of a plate spring having a small width but the same shape as the above spring, the spring 3 can be used easily. The pull tab 4 is in a rectangular shape and has at an end thereof a pintle 35.

The slider with the automatic locking mechanism is assembled, similarly to the second embodiment, by fitting the spring 3 into the recessed groove 21 inscribed on the upper wing plate 5 of the body 1 such that the projecting portion 33 of the spring 3 faces the recessed portion 13, and simultaneously inserting the spring 3 through the gap portion 37 of the support lug 10 such that a tip end of the spring 3 projects out of the support lug 10. Then, the projections 12 projecting from a center of the upper wing plate 5 are caulked on the spring 3 to fix the spring 3. The pawl member 2 which has a cover body is placed over to cover the support lug 10 and the guide lug 11 in a state wherein the pintle 35 of the pull tab 4 abuts on the recess 28 of the pawl member 2. Simultaneously, the pressing portion 25 of the pawl member 2 is brought into resilient contact with an end of the spring 3 projecting out of the support lug 10, and the hook 30 at the other end of the pawl member 2 is disposed to engage with the hooked portion 24. After fitting and inserting the locking pawls 26 on the opposite sides of the pawl member 2 into the pawl holes 14 defined on the opposite positions of the guide lug 11, the side walls 38 on the opposite sides of the pawl member 2 are punched against the shaft hole 36 of the support lug 10 so that the pawl member 2 can be pivotally moved relative to the body 1, thereby assembling the slider with the automatic locking mechanism.

It is also possible to define shaft holes in the side walls 38 of the pawl member 2, and insert a support shaft into the shaft holes for axially supporting the pawl member 2. It is also possible that the recessed groove 21 into which the spring 3 can be disposed is not defined in the upper face of the upper wing plate 5, but only a recessed portion 13 is defined at a center of the flat upper face of the upper wing plate 5 similarly to the first embodiment, in which case, the projecting portion 33 formed on the bent portion 32 of the spring 3 is fitted into the recessed portion 13 and is fixed by caulking the projections 12. When the spring 3 is mounted, it is also possible to dispose a spring 3 in a shape of a straight line on the recessed groove 21 and then to mold the spring 3 into the V-shape by punching in the recessed portion 13.

A operation of the assembled slider with the automatic lock mechanism is as follows. If the pull tab 4 is pulled forward or rearward, the pawl member 2 moves pivotally about a pivotal support point as a center until the hook 30 of the pawl member 2 abuts on the hooked portion 24 of the guide lug 11. At the same time, the pressing portion 25 presses an end of the spring 3, such that the locking pawl 26 can be lifted for allowing the slider to slide freely. If the pull tab 4 is released, the pressing portion 25 is pushed up by a resilient force of the spring 3, and the locking pawl 26 projects automatically to be inserted between the fastener elements, thereby locking the slider.

The slide fastener slider with the automatic lock mechanism of the invention has the above-described structures, and has the following effects according to the structures.

According to the present invention, the support lug 10 and the guide lug 11 are formed on the body 1, the recessed portion 13 is defined between the support lug 10 and the guide lug 11, the projections 12 are formed in the vicinity of the recessed portion 13, the bent portion 32 of the spring 3 in the V-shape is fitted into the recessed portion 13 , and the spring 3 is fixed by caulking the projections 12. Therefore, the spring 3 for activating the pawl member 2 having the locking pawl 36 can be easily disposed and assembled, and the slider is suitable for an automatic assembly process. Moreover, the mounted spring 3 does not fall off or displace even when used for a long time and has desirable performance and durability.

Furthermore, according to the present invention, one end of the spring 3 is brought into resilient contact with the pressing portion 25 of the pawl member 2 and the other end of the spring 3 is disposed in the guide lug 11. The locking pawl 26 defined in the end of the pawl member 2 is retractably fitted and inserted into the pawl hole 14 defined on the side of the guide lug 11 on the upper wing plate 5. The pintle 35 of the pull tab 4 is fitted into the recess 28 at the intermediate position of the pawl member 2 such that the end of the pawl member 2 can move pivotally along the guide lug 11. Therefore, the automatic lock mechanism is simple in structure, and the slider has a strong resilience and is particularly suitable for the wire spring. Further, the pivotal movement of the pawl member 2 can be appropriately guided on the locking pawl side, and the slider has a locking function with a good performance such that activation of the locking pawl 26 is not displaced.

Furthermore, according to the present invention, the projections 12 are formed at opposite sides of the recessed portion 13 and the bent portion 32 of the spring 3 fitted into the recessed portion 13 is fixed by caulking the projections 12 from opposite sides. Therefore the slider can be obtained, in which the spring 3 can be easily mounted, and the resilient force of the spring 3 mounted to the body 1 can be efficiently and appropriately exhibited.

Still further, according to the present invention, the projections 12 are formed at a position toward the support lug 10 deviating from opposite sides of the recessed portion 13, the bent portion 32 of the spring 3 is fitted into the recessed portion 13, and the spring 3 is fixed by caulking the projections 12 from opposite sides. Therefore, because the spring 3 is fixed after the bent portion 32 of the spring 3 is held by the recessed portion 13, the spring 3 can be mounted easily and accurately.

Still further, according to the present invention, the pressing portion 25 of the pawl member 2 is brought into resilient contact with the end of the spring 3, or the pressing portion 25 abuts on the upper wing plate 5 via the spring 3, so as to regulate the pivotal movement of the pawl member 2. Therefore, excessive lifting of the pawl member 2 at the time of pulling operation of the pull tab 4 can be prevented with a simple structure.

Still further, according to the present invention, the hook 30 is formed at the tip end of the base portion of the locking pawl 26 of the pawl member 2, the hooked portion 24 is formed at the bridge portion 17 of the guide lug 11, so that the hook 30 and the hooked portion 24 are engaged with each other, thereby regulating the pivotal movement of the pawl member 2. Therefore, the pivotal movement of the pawl member 2 at the time of the pulling operation of the pull tab 4 can be appropriately prevented on a side of the locking pawl.

Still further, according to the present invention, the bent portion 32 of the spring 3 has the angular projecting portion 33 projecting outward, the projecting portion 33 is fitted into the recessed portion 13, and the projections 12 are caulked to fix the spring 3. Therefore, the spring 3 can be further appropriately and easily disposed and fixed.

Still further, according to the present invention, the guide lug 11 on the body 1 includes opposite side walls 16 and the bridge portion 17, and the accommodating groove 18 having substantially the same width as the diameter of the spring 3 is defined in the inner face of the bridge portion 17. Therefore, rotation or deviation of the V-shaped spring 3 in the extending direction of the spring 3 can be prevented with the simple structure, and the spring 3 can be accurately activated and can exhibit excellent resilient force.

Still further, according to the present invention, the pawl member 3 has a solid body substantially in the a V-shape, the support lug 10 and the guide lug 11 stand on the body 1, the recessed portion 13 is defined between the support lug 10 and the guide lug 11, the spring 3 is accommodated in the recessed portion 12 and fixed by the projections 12, and the spring 3 is accommodated in the recessed streak groove 29 defined at the lower face of the front half portion of the pawl member 2 and the accommodating groove 18 defined in the guide lug 11. Therefore, the slider can be simple in structure, wherein the spring 3 can be accommodated in a stable state and can operate appropriately.

Still further, according to the present invention, the pawl member 2 has a solid body substantially in the angular U shape, the support lug 10 and the guide lug 11 stand on the body, the recessed portion 13 is defined between the support lug 10 and the guide lug 11, the spring 3 is accommodated in the recessed portion 15 and fixed by the projections 12, the recessed groove 21 is diagonally defined on the upper wing plate 5 and extending from the recessed portion 13 to the concave portion 20 on the front opening side, the pressing portion 25 of the pawl member 2 and the front half portion of the spring 3 are accommodated in the recessed groove 21, and the rear half portion of the spring 3 is accommodated in the accommodating groove 18 defined in the guide lug 11. Therefore, the spring 3 can be accommodated in a stable state and can operate appropriately and smoothly.

Furthermore, because the hook 30 is formed at the tip end of the pawl member 2 on the locking pawl side such that the hook 30 can be engaged with the hooked portion 24 formed at the bridge portion 17 of the guide lug 11 of the body 1, the locking pawl 26 can be appropriately detached from the fastener elements by pulling operation of the pull tab 4, and excessive lifting of the locking pawl 26 can be prevented in advance, hence the sliding operation can be carried out smoothly.

Still further, according to the present invention, the pawl member 2 has a cover body in a shape of a bottom of a ship, the support lug 10 and the guide lug 11 stand on the body 1, the gap portion 37 and the accommodating groove 18 each having substantially the same width as the spring 3 are respectively defined at the support lug 10 and the guide lug 11, the recessed portion 13 is defined between the support lug 10 and the guide lug 11 , the spring 3 is accommodated in the recessed portion 13 and fixed by the projections, one end of the spring 3 is inserted through the gap portion 37 of the support lug 10 and is brought into resilient contact with the pressing portion 25 of the pawl member 2, and the other end of the spring 3 is accommodated into the accommodating groove 18 of the guide lug 11. Therefore, the spring 3 can be accommodated in the stable slate and can be operated appropriately and smoothly. This slider is suitable for a slider having a pawl member 2 with a cover body.

Moreover, the hook 30 is formed inside the end portion on the locking pawl side of the pawl member 2, the hooked portion 24 is formed at the outer end of the guide lug 11 of the body 1, the hook 30 and the hooked portion 24 are engaged with each other, and the pawl member 2 which has a cover body covers the support lug 10 and the guide lug 11. Therefore, the locking pawl 26 can be appropriately detached from the fastener elements by pulling operation of the pull tab 4, excessive lifting of the locking pawl 26 can be prevented in advance, and the sliding operation can be carried out smoothly. Further, because the hook mechanism is within the cover and does not appear, the slider can have a good appearance. As described above, the present invention has remarkable effects.

What is claimed:

1. A slide fastener slider with an automatic lock mechanism comprising:

(a) a body including a support lug projecting on a guide post, a guide lug projecting at a rear opening side of an upper wing plate, a pawl hole defined inside or outside the guide lug, a recessed portion defined between the support lug and the guide lug, and a pair of projections projecting in a vicinity of the recessed portion;

(b) a pawl member having a locking pawl formed to project from one end portion of the pawl member, a pressing portion at the other end portion and a recess defined at an intermediate portion thereof, the pawl member being axially supported on the support lug in such a manner that the locking pawl is retractably fitted and inserted into the pawl hole;

(c) a spring bent into a V-shape to form a bent portion for being fitted into the recessed portion and fixed by caulking the projections, an end of the spring being brought into resilient contact with the pressing portion of the pawl member while the other end of the spring being disposed in the guide lug; and (d) a pull tab having a pintle for being fitted into the recess of the pawl member, so that the end portion of the pawl member can pivotally move along the guide lug.

2. A slide fastener slider with an automatic lock mechanism according to claim 1, wherein the projections project from opposite sides of the recessed portion inscribed on the upper wing plate, and the bent portion of the spring fitted into the recessed portion is fixed by caulking the projections from opposite sides.

3. A slide fastener slider with an automatic lock mechanism according to claim 1, wherein the projections project at a portion toward the support lug deviating from opposite sides of the recessed portion inscribed on the upper wing plate, the bent portion of the spring is fitted into the recessed portion, and the spring is fixed by caulking the projections from opposite sides.

4. A slide fastener slider with an automatic lock mechanism according to claim 1, wherein the pressing portion of the pawl member is in resilient contact with the end of the spring, or the pressing portion can abut on the upper wing plate via the spring, so as to regulate the pivotal movement of the pawl member.

5. A slide fastener slider with an automatic lock mechanism according to claim 1, wherein the pawl member has a hook defined at a tip end of a base portion of the locking pawl thereof, the guide lug has a hooked portion defined at a bridge portion thereof, so that the hook end the hooked portion can be engaged with each other so as to regulate the pivotal movement of the pawl member.

6. A slide fastener slider with an automatic lock mechanism according to claim 1, wherein the bent portion of the spring has an angular projecting portion projecting outward, the projecting portion is fitted into the recessed portion, and the projections are caulked to fix the spring.

7. A slide fastener slider with an automatic lock mechanism according to claim 1, wherein the guide lug projecting from the rear opening portion of the upper wing plate includes opposite walls and the bridge portion, and an accommodating groove with substantially the same width as a diameter of the spring is defined in an inner face of the bridge portion so as to prevent rotation of the spring.

8. A slide fastener slider with an automatic lock mechanism according to claim 1, wherein the pawl member has a solid body substantially in a V-shape, and further includes a support shaft projecting from opposite sides of a center of the pawl member and a recessed streak groove defined at a lower face between the recess and the pressing portion, the locking pawl projecting from a deviating position at a lower face of the one end portion of the pawl member, the recess being defined between the support shaft and the locking pawl, and a pair of the support lugs are formed to stand and face each other on the guide post, the accommodating groove being defined at a deviating position of the bridge portion of the guide lug standing at the rear opening portion, in which the spring is accommodated in the recessed portion and fixed by the projections, the support shaft of the pawl member is axially supported on the support lugs such that the locking pawl is retractably fitted and inserted into the pawl hole, the end of the spring is brought into resilient contact with the pressing portion along the recessed streak groove, and the other end of the spring is fitted and inserted into the accommodating groove of the guide lug.

9. A slide fastener slider with an automatic lock mechanism according to claim 1, wherein the pawl member has a solid body substantially in an angular U shape, and further includes a support shaft projecting from opposite sides of a center of the pawl member, the locking pawl projecting from a deviating position at a lower face of the one end portion of the pawl member, the hook portion projecting from a deviating position at a tip end of the other end portion of the pawl member, the recess being defined between the support shaft and the locking pawl, in which the pressing portion is retractably fitted and inserted into a concave portion on the guide post, the spring is accommodated into a recessed groove diagonally defined and extending from the concave portion to the recessed portion, the other end of the spring is fitted and inserted into the accommodating groove defined at a deviating position of the bridge portion of the guide lug, the support shaft is axially supported on a pair of the support lugs standing on opposite sides of the recessed groove to face each other, and the hook are engaged with the hooked portion at a deviating position of the bridge portion.

10. A slide fastener slider with an automatic lock mechanism according to claim 1, wherein the pawl member has a cover body in a shape of a bottom of a ship and includes a pair of locking pawls projecting from side walls at a rear portion of the pawl member, the hook formed by inwardly bending a lower portion of an end of the pawl member, and the pressing portion formed by inwardly bending a lower portion of the other end of the pawl member, the support lug and the guide lug have a gap portion and an accommodating groove each having substantially the same width as a diameter of the spring respectively defined at inner faces of the support lug and the guide lug, and the pawl hole is defined outside the guide lug, wherein the spring is accommodated into the recessed portion on the upper wing plate and is fixed by the projections, the pawl member is pivotally supported on the support lug so as to cover the support lug and the guide lug, the end of the spring is inserted through the gap portion of the support lug and is brought into resilient contact with the pressing portion, the other end of the spring is fitted and inserted into the accommodating groove of the guide lug, and the hooked portion projecting from the guide lug and the hook are engaged with each other.

* * * * *